US011175018B2

(12) United States Patent
Van Delden

(10) Patent No.: US 11,175,018 B2
(45) Date of Patent: Nov. 16, 2021

(54) RIGID LIGHTING UNIT

(71) Applicant: SIGNIFY HOLDING B.V., Eindhoven (NL)

(72) Inventor: Martinus Hermanus Wilhelmus Maria Van Delden, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/972,719

(22) PCT Filed: Jun. 6, 2019

(86) PCT No.: PCT/EP2019/064789
§ 371 (c)(1),
(2) Date: Dec. 7, 2020

(87) PCT Pub. No.: WO2019/234155
PCT Pub. Date: Dec. 12, 2019

(65) Prior Publication Data

US 2021/0254811 A1 Aug. 19, 2021

(30) Foreign Application Priority Data

Jun. 8, 2018 (EP) ..... 18176683

(51) Int. Cl.
*F21V 15/01* (2006.01)
*F21V 11/06* (2006.01)
(Continued)

(52) U.S. Cl.
CPC ..... *F21V 15/01* (2013.01); *F21V 11/06* (2013.01); *F21V 33/006* (2013.01);
(Continued)

(58) Field of Classification Search
CPC ..... F21V 15/01; F21V 11/06; F21V 33/006; F21V 15/02; F21V 15/00; F21V 11/00;
(Continued)

(56) References Cited

U.S. PATENT DOCUMENTS 7,137,727 B2 11/2006 Joseph et al.
7,303,305 B2 12/2007 Kennedy
(Continued)

FOREIGN PATENT DOCUMENTS

CN 205261454 U 5/2016
EP 2573461 A1 3/2013
(Continued)

*Primary Examiner* — Bao Q Truong
(74) *Attorney, Agent, or Firm* — Daniel J. Piotrowski

(57) ABSTRACT

A lighting unit (10) is disclosed comprising a torsion box (50) having a plurality of sidewalls (60) and a grid of internal walls (70), each of said internal walls extending between a pair of said sidewalls, said internal walls defining a plurality of compartments (80) within the lighting unit. At least one solid state lighting element (30) is located within at least some of said compartments, and a back panel (20) is arranged at a first opening (51) of the torsion box delimited by the sidewalls such that the back panel covers said compartments, wherein a second opening (53) of the torsion box delimited by said sidewalls opposing the first major opening defines a light exit window of the lighting unit. Also disclosed is a lighting kit comprising such lighting units, and wherein at least some internal walls (70) have a recessed central portion (72) having a height (H') of at most half the height (H) of said side walls (70).

14 Claims, 8 Drawing Sheets

(51) Int. Cl.

| | |
|---|---|
| ***G10K 11/162*** | (2006.01) |
| ***F21V 33/00*** | (2006.01) |
| *F21Y 115/10* | (2016.01) |
| *F21Y 105/16* | (2016.01) |

(52) U.S. Cl.
CPC ..... *G10K 11/162* (2013.01); *F21Y 2105/16* (2016.08); *F21Y 2115/10* (2016.08)

(58) Field of Classification Search
CPC ..... F21V 33/00; F21V 7/0083; F21V 5/007; G10K 11/162; F21Y 2105/16; F21Y 2115/10; F21Y 2105/10
See application file for complete search history.

(56) References Cited

U.S. PATENT DOCUMENTS

| | | | | |
|---|---|---|---|---|
| 8,328,391 | B2 * | 12/2012 | Snijder | F21V 11/06 362/249.02 |
| 9,147,390 | B2 * | 9/2015 | Swinkels | G10K 11/16 |
| 2017/0248289 | A1 * | 8/2017 | Vasylyev | F21V 7/0083 |

FOREIGN PATENT DOCUMENTS

| | | | |
|---|---|---|---|
| WO | 2007066260 | A1 | 6/2007 |
| WO | 2013038292 | A1 | 3/2013 |
| WO | 2013057610 | A1 | 4/2013 |

* cited by examiner

10

70

70

10

10

RIGID LIGHTING UNIT

CROSS-REFERENCE TO PRIOR APPLICATIONS

This application is the U.S. National Phase application under 35 U.S.C. § 371 of International Application No. PCT/EP2019/064789, filed on Jun. 6, 2019, which claims the benefit of European Patent Application No. 18176683.3, filed on Jun. 8, 2018. These applications are hereby incorporated by reference herein.

FIELD OF THE INVENTION

The present invention relates to a lighting unit comprising one or more solid state lighting elements, typically a lighting panel such as a large area lighting panel having an area of 1 $m^2$ or more.

The present invention further relates to a lighting kit including such lighting units.

BACKGROUND OF THE INVENTION

Advances in lighting technology such as the introduction of solid state lighting (SSL), e.g. as implemented by light emitting diode (LED)-based lighting modules, has transformed the lighting field. For example, lighting panels having very large surface areas, e.g. surface areas of several square meters (m2), such as panels having a surface area in the range of 1-20 $m^2$ by way of non-limiting example, are now available that can transform the lighting experience in enclosed spaces such as large rooms, offices, halls and the like. Such panels, which may be composed of one or more lighting modules, in some application domains are provided as at least part of the ceiling of such enclosed spaces, where they provide substantially homogeneous lighting emanating from parts of the ceiling defined by such panels.

For example, U.S. Pat. No. 7,303,305 B2 discloses a ceiling tile system comprises modular acoustic light-emitting modules, which can be of a standard size to be fitted into a hung ceiling or other ceiling system in conjunction with similar acoustic light-emitting modules or conventional ceiling tiles. Each acoustic light-emitting module includes a backing panel, a cover, and a rigid spacing member extending between the backing panel and the cover, with solid state light-emitting (SSL) elements such as light-emitting diodes (LEDs) arrayed within each module.

One particular challenge associated with such (large area) lighting units is that in order to provide such lighting units with the desired structural rigidity, the housing and in particular the sidewalls of such lighting units need to be sufficiently robust in order to prevent buckling and warping of the lighting unit, for example when a fabric is spanned across the light exit window of the lighting unit to diffuse the luminous output of the SSL elements. For this reason, relatively thick metal frames are typically used for this purpose, which can be costly and complex to make.

WO-2007/066260 discloses a lighting module having a plurality of LED groups arranged adjacent to each other in an array on a carrier. The lighting module further has a mesh arranged at the carrier and a front diffuser plate arranged in front of the mesh. The mesh has walls, which are arranged in a geometrical pattern forming a plurality of cells, such that the light emitted from at least some of the LED groups is mixed before passing the diffuser plate.

SUMMARY OF THE INVENTION

The present invention seeks to provide a lighting unit in which the desired structural rigidity can be achieved in a more cost-effective manner.

The present invention further seeks to provide a lighting kit comprising a plurality of such lighting units.

According to an aspect, there is provided a lighting unit comprising a torsion box having a plurality of sidewalls and a grid of internal walls, each of said internal walls extending between a pair of said sidewalls, said internal walls defining a plurality of compartments within the lighting unit; at least one solid state lighting element within at least some of said compartments; and a back panel arranged at a first opening of the torsion box delimited by the sidewalls such that the back panel covers said compartments, wherein a second opening of the torsion box delimited by said sidewalls opposing the first major opening defines a light exit window of the lighting unit, and wherein at least some internal walls have a recessed central portion having a height of at most half the height of said side walls.

In accordance with embodiments of the present invention, a lighting unit is provided in which the structural rigidity is provided by the internal walls of the torsion box. This has the advantage that the overall weight of the lighting unit may be significantly reduced, as the structural rigidity, and in particular the resistance to warping or buckling, is no longer provided by the sidewalls but instead is provided by the internal walls extending between two sidewalls, typically opposing sidewalls, such that the internal walls resist the inward collapse of these sidewalls. Consequently, the sidewalls no longer have to be rigid themselves, which means that the thickness of the sidewalls can be significantly reduced, thereby reducing the overall weight and manufacturing complexity of the lighting unit.

In the lighting unit, at least some internal walls have a recessed central portion having a height of at most half the height of said side walls. The height of a sidewall is defined as its dimension between the opposing major openings of the torsion box. The opening or recess in the central portion of the internal walls typically faces the light exit window of the lighting unit. This has the advantage that ghost imaging of the compartments at the light exit window of the lighting unit when the light exit window is covered by an optically transmissive member is effectively suppressed. Moreover, such recesses optically interconnect the different compartments within the lighting unit such that colour mixing within the lighting unit can take place between compartments, thereby improving the homogeneity in terms of spectral composition of the luminous output of the lighting unit.

Where the torsion box is provided with at least some internal walls having recessed central portions, such internal walls may further comprise at least one end portion adjacent to said recessed central portion that is shaped to act as an abutment between said central portion and the sidewall contacting the end portion in order to improve the support to the sidewalls provided by such an internal wall, such that the sidewall is supported over its full height. To this end, the abutment preferably is dimensioned such that its side surface contacting the sidewall has the same height as the sidewall.

Preferably, each internal wall having said recessed central portion comprises a pair of opposing end portions adjacent to said recessed central portion that each are shaped to act as abutments between said central portion and the pair of sidewalls in between which the internal wall is arranged such that both sidewalls are fully supported by such abutments.

In an embodiment, each of said abutments has a slanted surface contacting the sidewall such that the torsion box increases in width towards the light exit window. In other words, such slanted abutments force the opposing sidewalls of the torsion box apart, which for instance may be beneficial to tension a fabric across the light exit window and/or to clamp the back panel in between end sections of the sidewalls.

The back panel may be an acoustically absorbent panel such as an acoustically absorbent tile or the like. This has the further advantage that sound waves penetrating the lighting unit through its light exit window may be largely absorbed by the lighting unit, which is particularly beneficial where the lighting unit defines or forms part of a large area lighting panel, e.g. having an area of 1 $m^2$ or more, covering a surface such as a wall or ceiling such that the lighting unit may contribute to improving the acoustics in a space delimited by such a surface.

The lighting unit preferably further comprises a fabric spanning said second opening and defining the light exit window. Such a fabric, e.g. a woven fabric such as a knitted fabric or the like, provides the lighting unit with optical and acoustic transmissivity in a light-weight fashion whilst at the same time obscuring the SSL elements from direct view.

To further obscure the SSL elements, the lighting unit may further comprise a felt-based volumetric diffuser in between the fabric and the internal walls of the torsion box. Such a felt-based volumetric diffuser, e.g. a felt mat or the like, can achieve a more effective obscuring of the SSL elements independent of the viewing angle under which a person is directly looking at the lighting unit, whilst not significantly deteriorating light output efficiency and acoustic absorbance of the lighting module. For instance, the felt-based volumetric diffuser may have a constant optical density such that a constant optical performance over the full area of the light exit window of the lighting unit is achieved. To this end, the felt may be composed of non-woven, linearly aligned (hollow) fibres, in which the fibres are linearly aligned substantially parallel to the plane of the light exit window of the lighting unit, such that light and sound waves can pass around the fibres without significantly affecting the light output efficiency and acoustic absorbance of the lighting module.

In an embodiment, each compartment of the lighting unit comprises a solid state lighting element centered in said compartment in order to produce an even distribution of luminous output from each compartment.

Depending on the fire retardancy requirements of the lighting unit, the internal walls of the torsion box may be made of metal or a polymer material, e.g. polycarbonate or poly (methyl methacrylate). Where a higher degree of fire retardancy is required, metal (including metal alloys) may be used, whereas where a lower degree of fire retardancy is acceptable, a lighter polymer material may be used instead to further reduce the overall weight of the lighting unit, which has the additional advantage that the internal walls may be optically transmissive to facilitate light mixing within the torsion box, such that in such embodiments the internal walls may not comprise the recessed central portion.

In an embodiment, at least a section of each sidewall proximal to the light exit window is optically transparent. This may improve the aesthetical appearance of the lighting unit, as such an optically transparent section may give the lighting unit a rimless appearance.

Additionally or alternatively, each internal wall may be at least partially optically transparent in order to improve light mixing within the lighting unit. To this end, each internal wall for example may comprise one of a perforated plate and a lattice structure in case of the internal walls being made of an opaque material such as a metal or a metal alloy. Alternatively, each internal wall may be made of an optically transparent material such as a polymer as previously explained.

According to another aspect, there is provided a lighting kit comprising a plurality of lighting units according to any of the herein described embodiments, wherein the lighting units are configured to be coupled to each other. In this manner, large area lighting panels may be constructed in a modular manner by combining a plurality of the lighting units according to one or more embodiments of the present invention, thereby significantly reducing the manufacturing complexity of such large area lighting panels.

A lighting panel assembled in such a manner may comprise lighting units each having a separate fabric over the housing (torsion box) of the lighting unit. Alternatively, the lighting kit may comprise a fabric that is common to the plurality of lighting units such that upon assembly of the lighting panel the woven fabric spans the plurality of lighting units.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
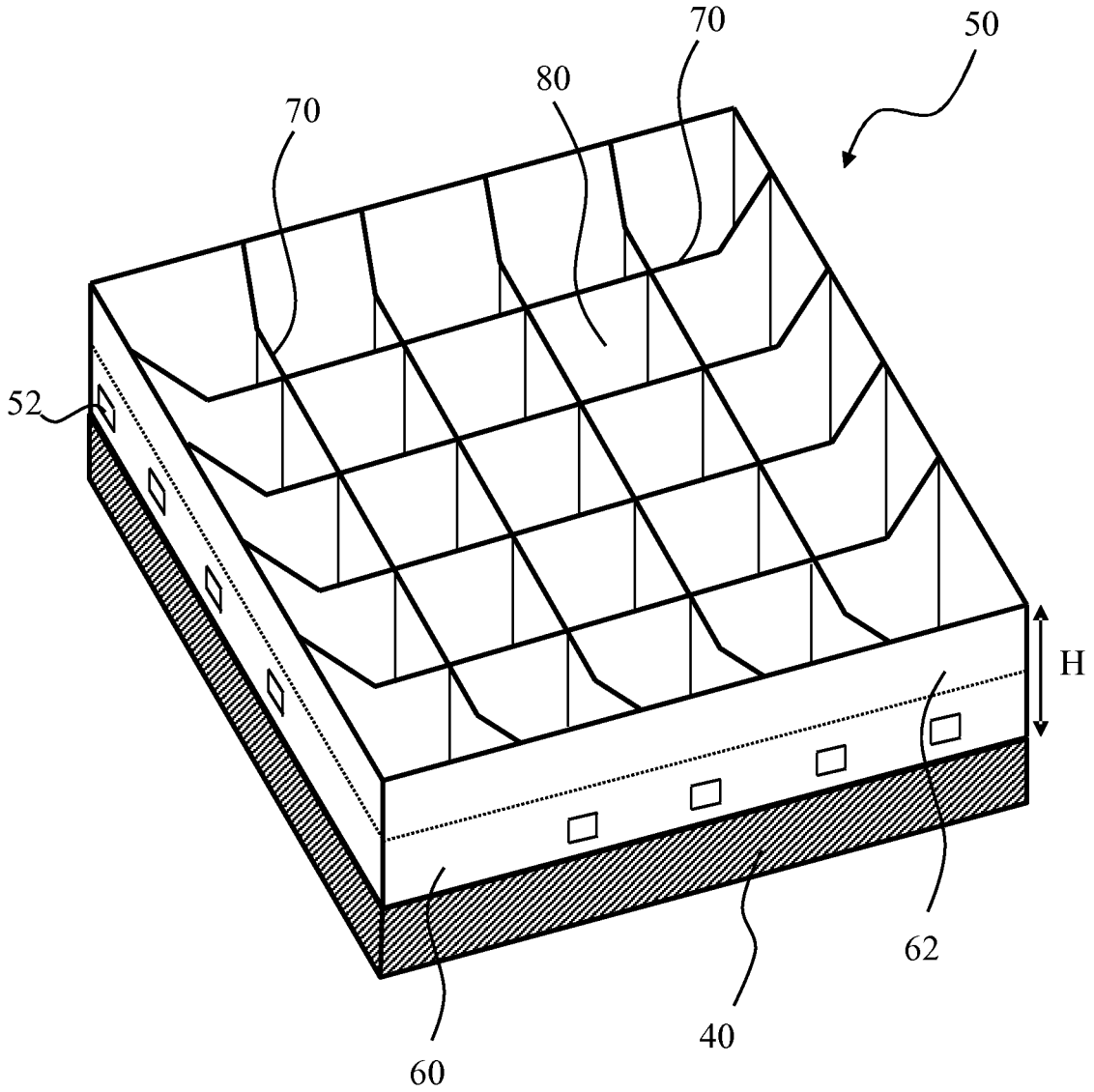
FIG. 1 schematically depicts a perspective view of a lighting unit according to an embodiment.

It should be understood that the Figures are merely schematic and are not drawn to scale. It should also be understood that the same reference numerals are used throughout the Figures to indicate the same or similar parts.

Figure 2:
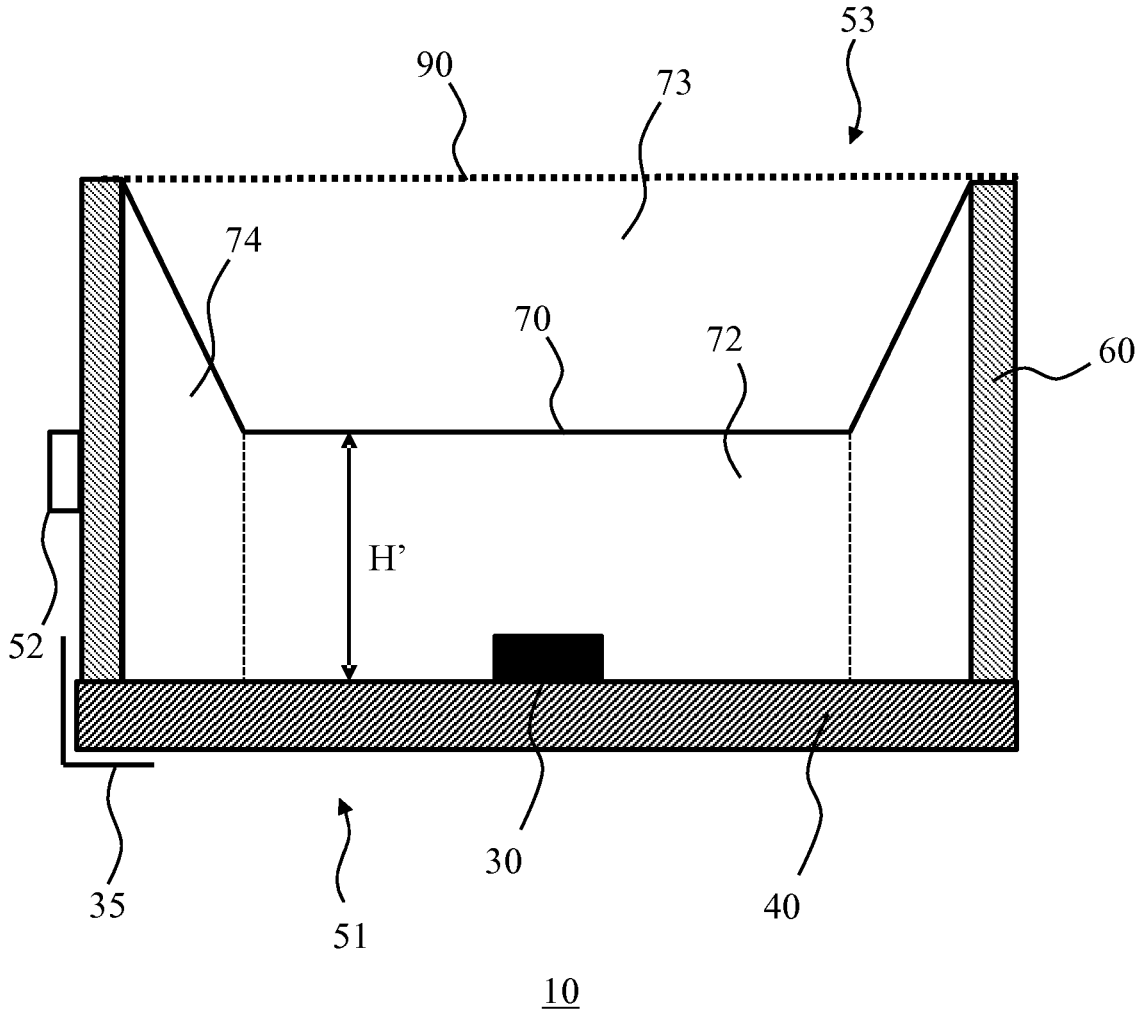
FIG. 2 schematically depicts a cross-sectional view of a lighting unit according to an embodiment.

FIG. 1 schematically depicts a perspective view and FIG. 2 schematically depicts a cross-sectional view of a lighting unit 10 according to an embodiment of the present invention. The lighting unit 10 comprises a torsion box 50, which torsion box 50 comprises sidewalls 60 arranged in a grid defining the at least part of the housing of the lighting unit 10 and an arrangement of internal walls 70 delimiting a plurality of compartment 80 within the torsion box 50. Each internal wall 70 extends between a pair of opposing sidewalls 60 and is affixed to these sidewalls such that the internal wall prevents the frame of the torsion box 50 formed by its sidewalls 60 from collapsing. As schematically depicted in FIGS. 1 and 2, the internal walls 70 are affixed to opposing sidewalls 60 using respective clamping members 52 extending through the opposing sidewalls 60, such as a pin and ring lock arrangement by way of non-limiting example. Any suitable clamping member may be used for this purpose. Alternatively, the lighting unit 10 may further comprise a back panel 20 such as a bottom plate arranged over a first opening 51 of the torsion box delimited by the sidewalls 60 to which the respective internal walls 70 are clamped in any suitable manner. The back panel 20 may act as a further stiffening member of the torsion box 50 by providing additional rigidity thereto. In yet another embodiment, the internal walls 70 are permanently connected to the sidewalls 60, e.g. through soldering, welding or the use of an adhesive. Many other ways of affixing the internal walls 70 to the sidewalls 60 will be immediately apparent to the skilled person and it should be understood that any suitable way of affixing the internal walls 70 to the sidewall 60 may be used within the context of the present application. Additionally, mechanical reinforcement members may extend through inner cavities within the (lower halves of the) sidewalls 70, which are affixed to the sidewalls 60 or the back panel 20 to increase the structural rigidity of the torsion box 50.

The compartments 80 are shown to have a rectangular shape by way of non-limiting example only. The compartments 80 may take any suitable shape, e.g. any suitable polygonal shape such as a triangular shape, a pentagonal shape, a hexagonal shape, and so on. Furthermore, it is not essential that the torsion box 50 is compartmentalised in a regular manner as it is equally feasible to provide a torsion box 50 comprising irregularly shaped compartments 80.

In the lighting unit 10 according to embodiments of the present invention, the structural integrity (rigidity) of the lighting unit 10 is provided by the framework of the internal walls 70 within the torsion box 50 such that the sidewalls 60 do not need to provide substantial structural support, which has the advantage that the sidewall 60 may be kept rather thin. In addition, due to the torsion provided by the framework of the internal walls 70, the individual internal wall 70 themselves can be kept rather thin as well such that the overall weight of this part of the housing of the lighting unit 10 is significantly reduced compared to prior art arrangements in which the structural integrity of the lighting unit 10 was provided by the external frame (i.e. sidewalls 60) of its housing.

At least some of the compartments 80 comprise at least one SSL element 30 arranged to produce a luminous output towards the light exit window defined by the second opening 53 of the torsion box 50 delimited by the sidewalls 60 and opposing the first opening 51. In a particular embodiment, each compartment 80 comprises one or more SSL elements 30 centered within the compartment 80 in order to produce a homogeneous illumination of the light exit window of the lighting unit 10. The SSL elements 30 may be are distributed in a regular pattern such as a regular grid or array across the back panel 20. However, it should be understood that the SSL elements 30 may be provided in any pattern, e.g. an irregular pattern, and do not need to be centered within the compartments 80, e.g. when achieving luminous homogeneity at the light exit window is not required. The SSL elements 30 may be directly mounted on the back panel 20 or alternatively may be provided on a metal strip or a strip of another heat-conductive material to assist the cooling of the SSL elements 30. Such a strip may comprise a plurality of through holes to make the strip more acoustically transparent, for reasons that will become apparent below. The SSL elements 30 may be arranged to directly or indirectly illuminate the light exit window of the lighting unit 10, as will be apparent to the skilled person.

The SSL elements 30 may take any suitable shape. In at least some embodiments, the SSL elements 30 are LEDs such as COB LEDs. COB LEDs have a high luminous output which can assist in giving the lighting unit 10 a bright appearance. In case of the presence of a plurality of SSL elements 30 within the lighting unit 10, the SSL elements 30 may be identical, e.g. white light LEDs, or may be different to each other, e.g. different coloured LEDs. The SSL elements 30 may be addressable as a single group, i.e. in unison, or may be individually addressable or may form part of an individually addressable group of SSL elements 30 in which case the arrangement of SSL elements 30 typically comprises a plurality of groups of SSL elements 30, e.g. groups of SSL elements 30 producing a different luminous output such as different coloured output. The one or more SSL elements 30 may be dimmable as will be readily understood by the skilled person. Alternatively, the luminous output intensity of the lighting unit 10 may be controlled by switching on different numbers of SSL elements 30. In the latter scenario, the SSL elements 30 that are switched on in order to control the luminous output intensity of the lighting unit 10 preferably are distributed across the lighting unit 10 in order to preserve as much as a homogeneous illumination of the light exit window of the lighting unit 10.

The torsion box 50 may be made of a metal such as aluminium, a metal alloy such as steel, and so on. This is particularly desirable where the lighting unit 10 needs to meet stringent fire retardancy requirements. Alternatively, where such fire retardancy requirements are less stringent, at least the internal walls 70 of the torsion box 50 may be made of a polymer such as polycarbonate, poly (methyl methacrylate), and so on, which has the advantage of further reducing the weight of the lighting unit 10 whilst at the same time providing optically transmissive internal walls 70 within the torsion box 50 such that the space within the torsion box 50 in which the internal walls 70 are located can act as a light mixing chamber of the lighting unit 10.

In a preferred embodiment, the back panel 20 consists of or comprises an acoustically absorbent material. This may be any suitable acoustically absorbent material that takes any suitable shape such as an acoustically absorbent mat or tile or the like. Suitable acoustically absorbent materials include fibrous materials that are commonly deployed in traditional acoustic tiles, such as glass wool, foam-based materials such as a melamine foam, polyurethane foam, and so on, as well as micro-perforated plates. Such micro-perforated plates may have a surface area of which about 0.2-0.5% is perforated with microscopic holes having a diameter in a range of 0.05-0.5 mm although other dimensions are of course equally feasible. Such micro-perforated plates may be folded in order to achieve the desired dimensions of the back panel 20.

The acoustically absorbent material, e.g. the micro-perforated plate or any other acoustically absorbent material, may be filled with a substance that increases the acoustic absorbance of the acoustically absorbent material to further improve the acoustic performance of the lighting unit 10. The acoustically absorbent material may be covered by a light-reflective coating (not shown), e.g. a white paint coating or a reflective foil, in order to minimize light losses of light generated by the one or more SSL elements 30 that is incident on the acoustically absorbent material. In an example embodiment, the acoustically absorbent material such as a glass wool or the like is covered by a micro-perforated plate facing the light exit window of the lighting unit 10, in which the micro-perforated plate not only acts as a further acoustically absorbent material but additionally acts as a light reflector to increase the optical efficiency of the lighting unit 10. To this end, the micro-perforated plate may be coated with a reflective coating, e.g. a white paint or the like. The back plate 20 may be affixed to the torsion box 50 in any suitable manner, e.g. using brackets or clips 35.

The second opening 53 of the torsion box 50 may be covered by a light diffusive member to obscure the SSL elements 30 within the compartments 80 of the torsion box 50 from direct view. In case the back panel 20 comprises or consists of an acoustically absorbent material, such a light diffusive member should be acoustically transparent such that sound waves can travel through the light diffusive member and can reach the back panel 20. In a particularly advantageous embodiment, such a light diffusive member comprises a fabric or cloth 90, which may be spanned or tensioned across the second opening 53 of the torsion box 50 such that the light emitted by the one or more SSL elements 30 through the fabric or cloth 90. The fabric or cloth 90 obscures the one or more SSL elements 30 from direct view. The fabric or cloth 90 typically is a woven fabric in which holes are present in between the intertwined fibres or threads of the fabric or cloth 90 which allow for sound waves to pass through the cloth or fabric 90 towards the acoustically absorbent material in the back panel 20, where such sound waves may be absorbed, whilst at the same time allowing for light emitted by the one or more SSL elements 30 to pass through the fabric or cloth 90 in the opposite direction. In at least some embodiments, the SSL elements 30 are arranged such that their light emitting surfaces are facing the fabric or cloth 90 such that the fabric or cloth 90 is directly illuminated by the one or more SSL elements 30, but it should be understood that other arrangements, e.g. side-lit and indirect lit arrangements, may also be contemplated.

The fabric or cloth 90 may be made of any suitable woven or knitted material that is both optically and acoustically transmissive, e.g. optically and acoustically transparent. Where the optical unit 10 is to be used as a standalone luminaire, the fabric or cloth 90 typically spans a single lighting unit 10. Alternatively, in embodiments in which the luminaire comprises a housing that houses a plurality of lighting units 10, the fabric or cloth 90 may span the entire housing such that the fabric or cloth 90 is common to the plurality of lighting units 10 mounted in such a housing. In yet another embodiment, such a luminaire may be formed by a plurality of lighting units 10 each having their dedicated fabric or cloth 90 acting as a light exit window, in which case the respective lighting units 10 may be assembled together to form the luminaire in any suitable manner, e.g. by suspension in a mounting frame or the like. The fabric or cloth 90 may be tensioned over such a housing or across the torsion box 50 in any suitable manner. As this is entirely routine to the skilled person, this will not be explained in further detail for the sake of brevity only.

The internal walls 70 may have the same height H as the sidewalls 60 across their entire width because inter-compartmental light mixing can take place due to the optical transmissivity of the internal walls 70. However, such full height internal walls 70 can cause ghost imaging of the compartments 80 onto the light exit window of the lighting unit 10, in particular where such a light exit window is formed by a light diffusive member such as the fabric or cloth 90, where the framework of such full height internal walls 70 can lead to shaded regions on the light exit window corresponding to the framework. In order to suppress such ghost imaging of the compartments 80 onto the light exit window of the lighting unit 10, the internal walls 70 of the torsion box 50 may comprise a recessed central region 72 having a height H' that is reduced compared to the height H of the sidewalls 60 such that a cavity 73 is formed above the central regions 72 of the internal walls 70, i.e. in between the central regions 72 and the light exit window of the lighting unit 10, in which light mixing can occur such that the ghost imaging of the compartments 80 onto the light exit window can be reduced. This recessed central region 72 of the internal walls 70 of the torsion box 50 is schematically depicted in FIG. 1 and FIG. 2. Preferably, $H' \leq 0.5*H$ to facilitate sufficient light mixing within the cavity 73 in order to effectively suppress such ghost imaging.

As will be readily understood by the skilled person, where such internal walls 70 have a reduced height H' compared to the height H of the sidewalls 60 across their entire width, the upper edges of the sidewalls 60, i.e. the portions of the sidewalls 60 not supported by the internal walls 70, may be more prone to inward collapse. Although this may not be problematic in some embodiments, in alternative embodiments in which the full height H of the sidewalls 60 should be supported by the internal walls 70 in order to provide the torsion box 50 with its desired structural rigidity, each sidewall 70 comprising a recessed central region 72 may further comprise at least one end portion 74 flanking such a recessed central region 72 that is shaped as an abutment, i.e. has a height that increases from H' proximal to the central region 72 to height H of the sidewall 60 facing the abutment at the end of the abutment proximal to this sidewall. Preferably, the internal walls 70 comprising such a recessed central region 72 each comprise a pair of such abutments at the opposite ends of the recessed central region 72 such that the opposing sidewalls 60 of such an internal wall 70 both are supported by the internal wall 70 across their full height H. This for instance prevents the inward collapse of the upper regions of the sidewalls 60, i.e. the regions delimiting the second opening 53 of the torsion box 50 when a cloth or fabric 90 is tensioned across the second opening 53 by attaching it to the sidewalls 60 of the torsion box 50. As will be readily understood by the skilled person, the end regions 74 defining the abutments of the internal walls 70 redistribute the forces working on the sidewalls 60 across the reduced height central region 72 of the internal walls 70, such that the sidewalls 60 are supported across their full height despite the reduced height of the central region 72 of such internal walls 70. It is noted for the avoidance of doubt that the provision of internal walls 70 having a recessed central region 72 is not limited to internal walls 70 that are opaque or translucent; such recessing of the internal walls 70 equally may be used with internal walls 70 that are optically transmissive (transparent) to reduce residual ghost imaging of the compartments 80 onto the light exit window.

In an embodiment, the sidewalls 60 may at least be partially optically transmissive. More specifically, the sidewalls 60 may comprise a region 62 surrounding the second opening 53 that is optically transmissive, e.g. transparent, such that upon illumination of the light exit window of the lighting unit 10 with the one or more SSL elements 30, light is also transmitted through this region 62, which gives the lighting unit 10 a rimless appearance. Optionally, the sidewalls 60 may comprise a decorative optically transmissive pattern to improve the aesthetics of the lighting unit 10.

Figure 3:
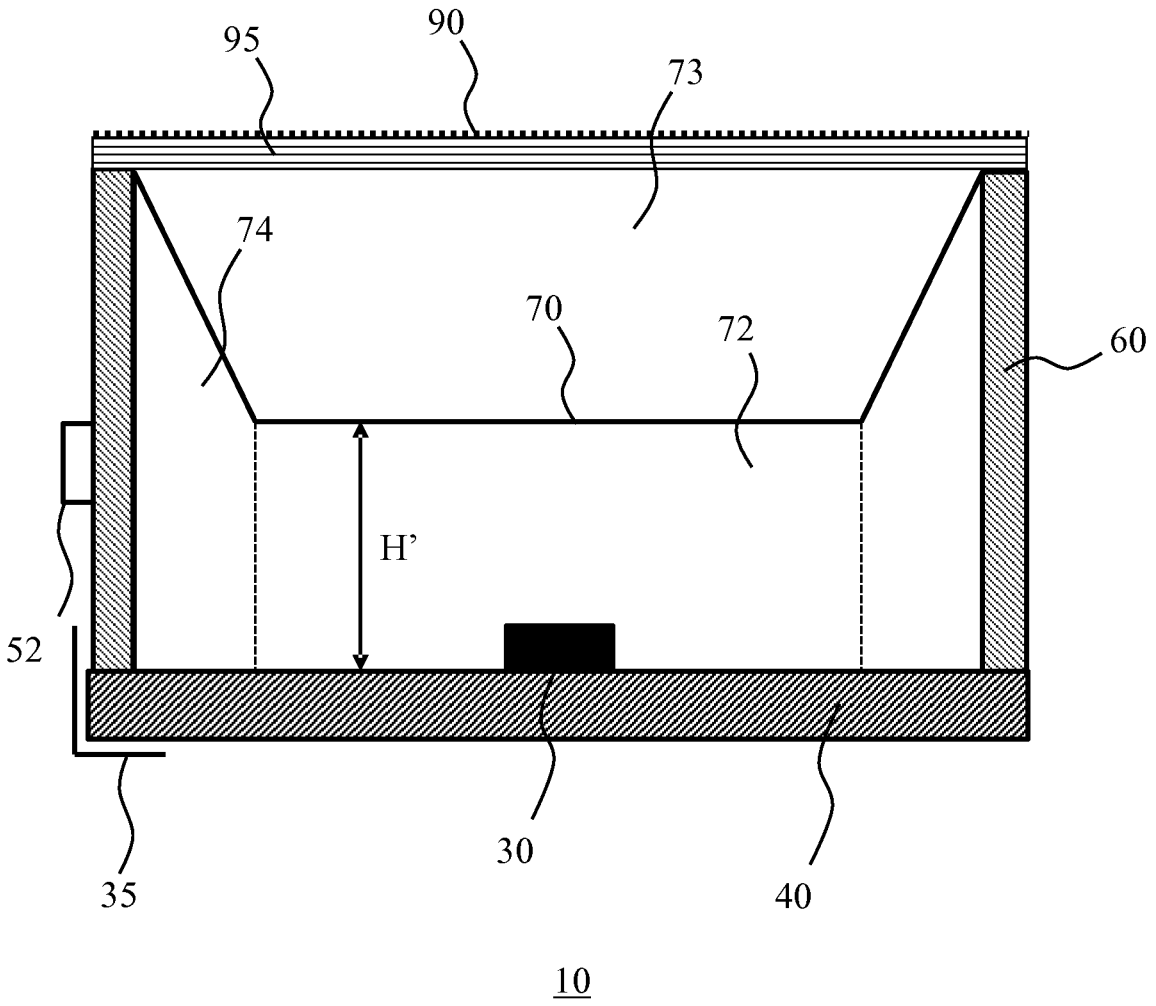
FIG. 3 schematically depicts a cross-sectional view of a lighting unit according to another embodiment.

FIG. 3 schematically depicts a cross-sectional view of a lighting unit 10 according to another embodiment, in which the lighting unit 10 further comprises a felt-based volumetric diffuser 95, from here on simply referred to as felt 95. The felt 95 is positioned in between the fabric or cloth 90 and the internal walls 70 of the torsion box 50 such that the felt 95 is not directly visible external to the lighting unit 10, but instead is hidden from direct view by the fabric or cloth 50. The presence of such a felt 95 further obscures the SSL elements 30 from direct view, in particular under non-perpendicular viewing angles of the lighting unit 10 and further assists in suppressing the previously explained ghost imaging onto the fabric or cloth 90.

In FIG. 3, the felt 95 is integral to the fabric or cloth 90 such that the felt 95 is supported by the fabric or cloth 90. In this manner, when tensioning the felt 90 over the torsion box 50 of the lighting unit 10, the risk of tearing the felt 95 during such tensioning is significantly reduced. The felt 95 may be integrated into the fabric or cloth 90 during weaving or knitting of the fabric or cloth 50. Also, where a luminaire comprises a plurality of lighting units 10, the felt 95 may be common to the plurality of lighting units 10 as previously explained for the fabric or cloth 90.

In the context of the present invention, where reference is made to a felt 95, it should be understood that this term is intended to cover any pressed fibrous material such as a pressed fibrous mat or the like in which the fibres are matted or otherwise bound together and preferably extend linearly substantially in parallel with the opposing major surfaces of the pressed fibrous material, i.e. the felt 95, such that light (and sound) can pass through the felt 95 through spacings in between the fibres, with light incident of the fibres being scattered by the fibres, which gives the felt 95 its diffusive character. The fibres typically are non-woven, (hollow) fibres in which a cross-sectional dimension perpendicular to the length of the fibre will be referred to as the diameter of the fibre. Where reference is made to such a diameter, it should be understood that this does not necessarily imply that the fibres are (perfectly) tubular.

Although the embodiments of the present invention are not limited to particular types of felt 95, it is noted that felts made from (hollow) plastic, glass or quartz fibres are preferred due to the optical properties of such fibres. Due to the fire retardant (non-flammable) nature of glass and quartz fibres, such fibres are particularly preferred in embodiments where the felt 95 is exposed to elevated temperatures. Due to the fact that such (hollow) linear fibres can act as linear lenses, the diameter of such fibres preferably does not exceed 200 μm in order to avoid lens effects such as interference effects such as striping when light passes through the felt 95. The fibres in some embodiments of the present invention have a diameter in a range of 1-200 μm, preferably in a range of 5-100 μm and more preferably in a range of 5-50 μm. It has been found that the felt 95 retains excellent optical and acoustic transmissivity whilst avoiding lens effects when light passes through the fibres in the felt 95. If the diameter of the fibres is below 1 μm, the acoustic and optical transmissivity is adversely affected, whereas if the diameter of the fibres is above 200 μm, lens effects may start to appear at the fabric or cloth 90. Of course, where such lens effects are considered desirable, e.g. for aesthetic reasons, the fibres may have diameters exceeding 200 μm although this may compromise the ability of the felt to obscure the light engines within the lighting unit 10. From the foregoing, it should furthermore be understood that the fibres may be hollow or solid fibres, as the orientation of the fibres does not require light and sound waves to pass through the fibres. It is furthermore reiterated that although linear fibre-felts have been described, any suitable type of fibre-based felt having a constant optical density may be used, such as for example felts that are spun using a rotating 'shower-head'-style depositing member onto a stationary or rotating support, although such felts may be more costly. Such a rotary fibre deposition technique for example is advantageous when using hot plastic fibres, as in such a case no adhesive or binder may be required to adhere (stick) the individual fibres together.

In some embodiments, the fibres in the felt 95 may be bound by an adhesive or a binder that has a good optical transparency to light in the visible part of the electromagnetic spectrum, e.g. an optical transparency of at least 80%, preferably of at least 90%. An example of such a binder is PVA although many other binders or adhesives will be immediately apparent to the skilled person. In the felts 95 to be used in the present invention, it is preferred that where such binders or adhesives are deployed, they are deployed in the form of micro-droplets in between individual fibres to ensure a thin application of such adhesives or binders. Alternatively, the fibres are impregnated with such adhesives or binders. As will be readily understood by the skilled person, the presence of such an adhesive or binder immobilizes the fibers in the felt 95, thereby ensuring that the optical density of the felt 95 is not altered by reorganization of the fibres when the felt 95 is being handled.

Felts 95 based on non-woven fibres are preferred as such felts have a well-defined uniform optical density across the surface of the felt, which is not the case when using materials based on woven fibres such as wool or the like, where the intertwined nature of such fibres causes local variations in the optical density of the material. In the embodiments of the present invention, the felt 95 may have a density in a range of 35-100 g/m2 to ensure optimal optical performance of the felt. When the density of the felt 95 is in this range, the spacing between the fibres is sufficiently large to achieve a good optical transparency of the felt 95 whilst still obscuring the SSL elements 30 from direct view under certain viewing angles. The felt 95 may have a thickness in a range of 2-10 mm for the same reason, although other densities and thicknesses may be contemplated. Suitable felt materials are commercially available from for instance the Heraeus Group, Hanau, Germany and the Saint-Gobain Corporation of Paris, France.

Figure 4:
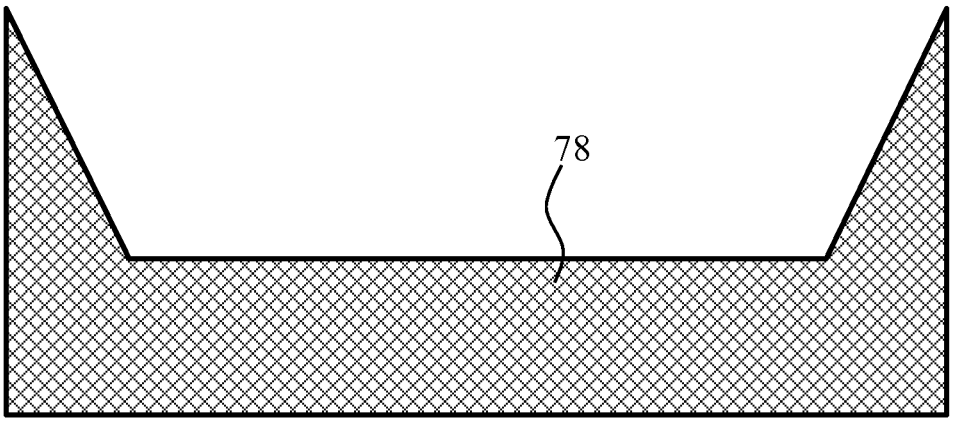
FIG. 4 schematically depicts a cross-sectional view of an aspect of a lighting unit according to an example embodiment.
Figure 5:
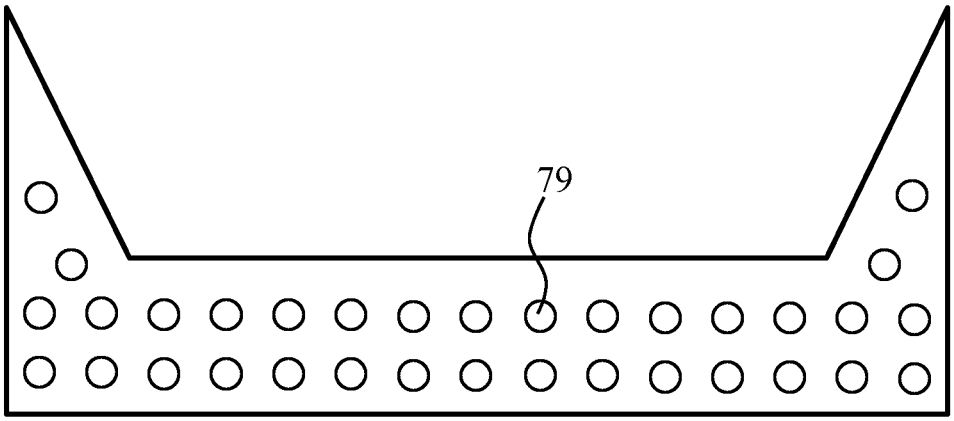
FIG. 5 schematically depicts a cross-sectional view of an aspect of a lighting unit according to another example embodiment.

The internal walls 70 of the torsion box 50 may be made optically transmissive by using an optically transmissive material such as a polymer as previously explained. Alternatively, in case of such internal walls 70 being made of a metal or metal alloy, optical transmissivity may be provided by opening the internal walls 70. For example, as schematically depicted in the cross-sectional view of such an internal wall 70 in FIG. 4, the internal wall 70 may comprise a lattice work 78 of cross bars through which light can travel between the compartments 80. Alternatively, as schematically depicted in the cross-sectional view of such an internal wall 70 in FIG. 5, the internal wall 70 may be perforated, i.e. comprise a pattern of through holes 79, through which light can travel between the compartments 80. It is noted for the avoidance of doubt that the internal walls 70 in FIGS. 4 and 5 are shown to have recessed central regions flanked by abutments by way of non-limiting example only, as the opening of such sidewalls is not limited to sidewalls 70 having a particular shape.

Figure 6:
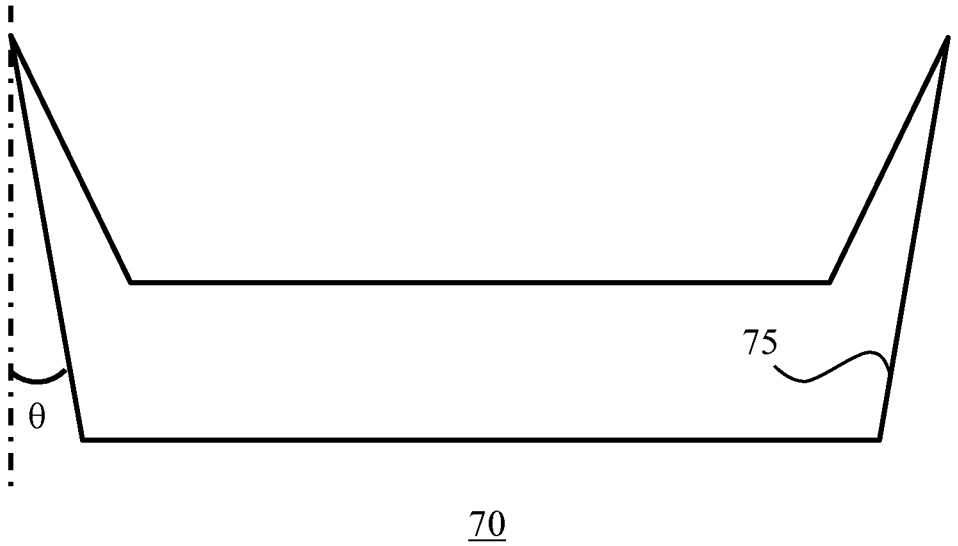
FIG. 6 schematically depicts a cross-sectional view of an aspect of a lighting unit according to yet another example embodiment.
Figure 7:
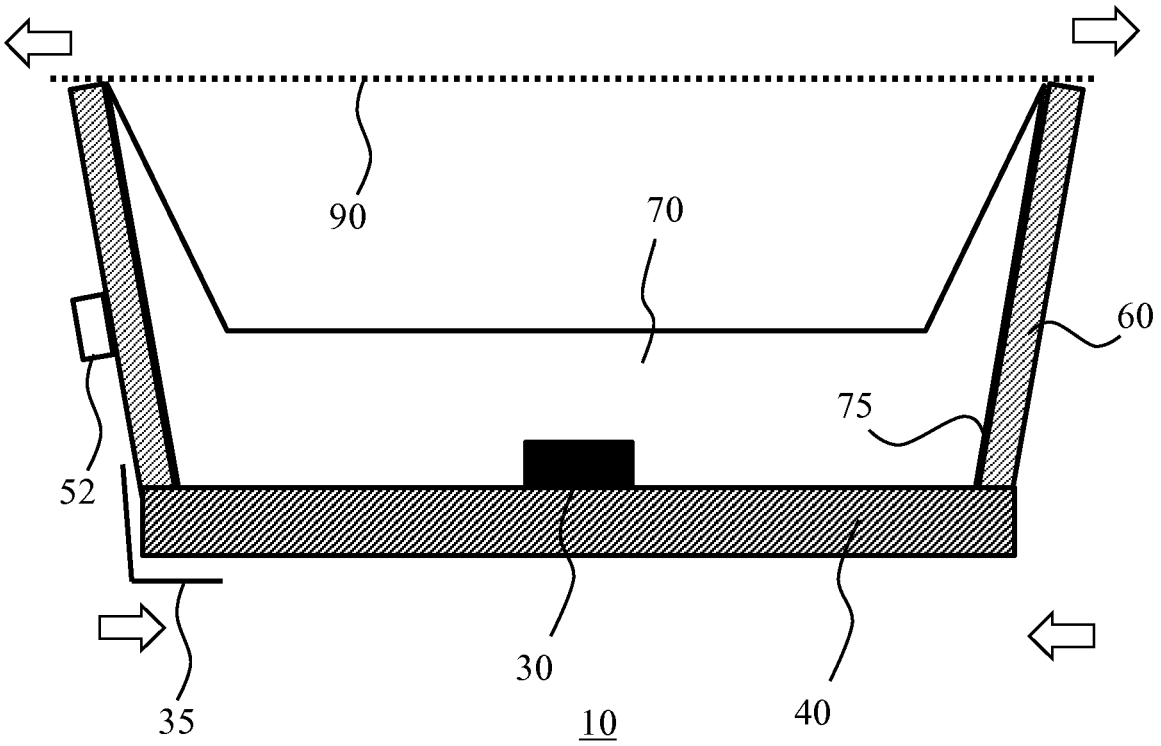
FIG. 7 schematically depicts a cross-sectional view of a lighting unit according to a further embodiment.
Figure 9:
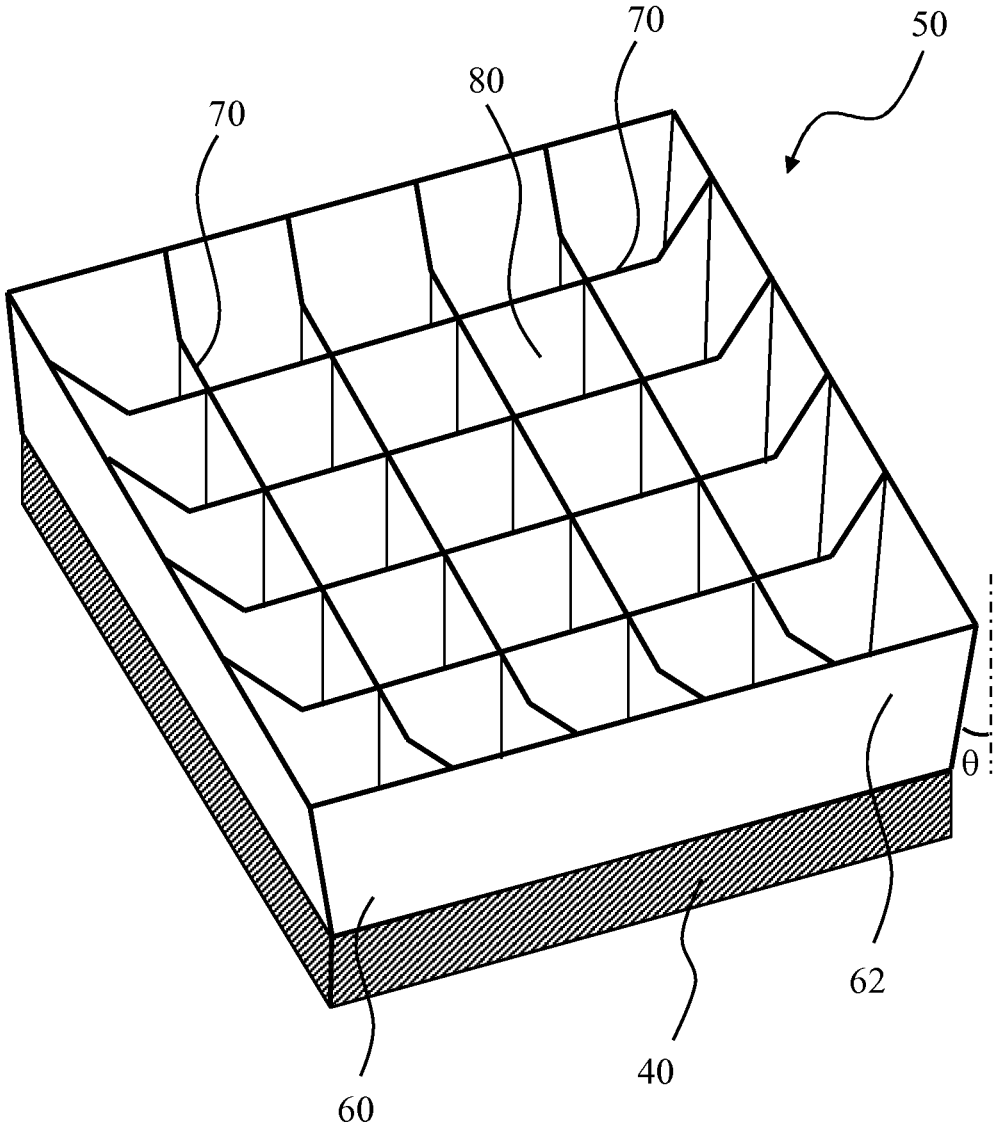
FIG. 9 schematically depicts a perspective view of a lighting unit according to still a further embodiment.

FIG. 6 schematically depicts a cross-sectional view of an internal wall 70 of the torsion box 50 according to yet another embodiment. In this embodiment, one or both of the side surfaces 75 of the internal walls 70 are negatively slanted relative to a vertical axis as symbolized by the angle θ such that upon insertion of the internal walls into the external frame of the torsion box 50 formed by the sidewalls 60, the sidewalls 60 are forced into a corresponding slanted orientation such that the second opening 53 becomes wider than the first opening 51 of the torsion box 50. This is schematically depicted in FIG. 7, which depicts a cross-sectional view of a lighting unit 10 comprising a torsion box 50 comprising such negatively slanted sidewalls 50. The angle θ typically is rather small, e.g. 10° or less or even 5° or less. A perspective view of such a lighting unit 10 is schematically depicted in FIG. 9.

Such slanting of the sidewalls 60 of the torsion box 50 may be leveraged in a number of advantageous ways. For example, the cloth or fabric 90 may be pre-tensioned across the second opening 53 of the torsion box 50, such that after insertion of the slanted internal walls 70 into the torsion box 50, the cloth or fabric 90 is further tensioned by the forces acting upon it as indicated by the block arrows over the cloth or fabric 90. These forces are generated by the negatively slanted internal walls 75 forcing the end portions of the sidewalls 60 proximal to the second opening 53 apart, which tensions the fabric or cloth 90 across the second opening 53, i.e. the light exit window, of the torsion box 50.

Additionally or alternatively, a shim plate may be used to increase the thickness of the sidewalls 60 to apply an additional tensioning force onto the fabric or cloth 90. For example, the fabric or cloth 90 may be attached to the sidewalls 60 prior to constructing the torsion frame 50 to further tension the fabric or cloth 90. Also, an adjustable abutment member such as a hinge plate may be attached to the sidewalls 60 such that by adjustment of the abutment member, e.g. by using a bolt or the like of a hinge plate to adjust its angle, the aperture of the light exit window may be adjusted, e.g. increased, to further tension the fabric or cloth 90. Other suitable measures to adjust the effective aperture of the light exit window in order to tension the fabric or cloth 90 will be immediately apparent to the skilled person.

Figure 8:
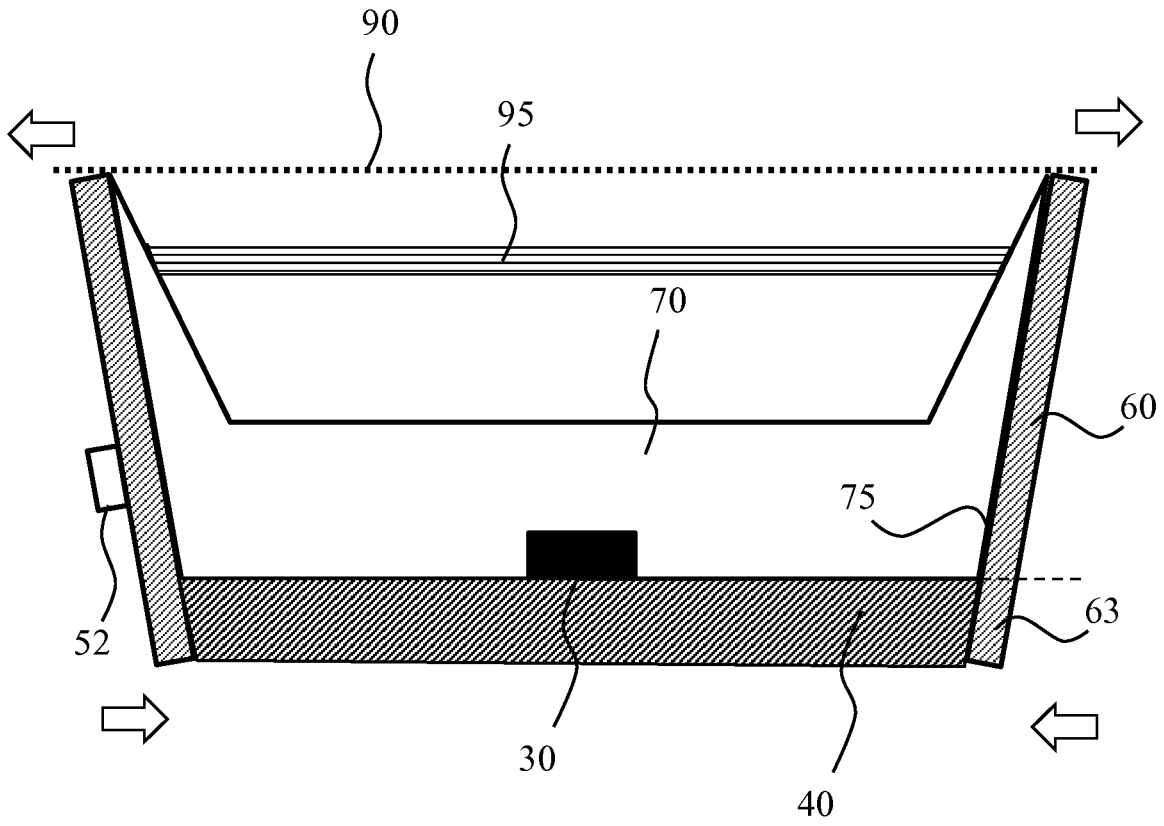
FIG. 8 schematically depicts a cross-sectional view of a lighting unit according to still a further embodiment.

As a further example, which is schematically depicted in the cross-sectional view of the lighting unit 10 in FIG. 8, the parting of the sidewalls 60 optimal to the second opening 53 further facilitates tensioning of the felt 95 when present across the second opening 53. Consequently, the felt 95 does not need to be integral to the cloth or fabric 90 but instead may be attached internally to the torsion box 50, e.g. to the inner surfaces of the sidewalls 60, such that upon insertion of the slanted internal walls 70 into the outer frame of the torsion box 50, the felt 95 is tensioned by the forces pushing out the regions of the sidewalls 60 proximal to the second opening 53. This therefore facilitates positioning of the felt 95 in any suitable location between the first opening 51 and the second opening 53 within the torsion box 50, such as spatially separated from the cloth or fabric 90.

The parting of the sidewalls 60 proximal to the second opening creates a counterforce at the opposite ends of the sidewalls 60, i.e. at the ends proximal to the first opening 51 of the torsion box 50. This is schematically depicted in FIG. 7 and FIG. 8 by the inward pointing block arrows at the bottom of the lighting unit 10. This inwardly directed counterforce may be used to clamp the back panel 20 into place such that separate fastening members, e.g. brackets or clips 35 do not have to be used in order to secure the back panel 20 against the torsion box 50. For example, the sidewalls 60 may have a bottom section 63 proximal to the first opening 53 extending beyond the internal walls 70 in between which the back panel 20 may be slidably inserted into the torsion box 50, such that the inwardly directed counterforces acting upon these bottom sections 63 retain the back panel 20 within the torsion box 50. It is noted for the avoidance of doubt that although the spatially separated felt 95 and the clamping of the back panel 20 by the bottom sections 63 of the sidewalls 60 are depicted in a single figure, it should be understood that these embodiments may be deployed independently within a lighting unit 10 according to embodiments of the present invention.

Figure 10:
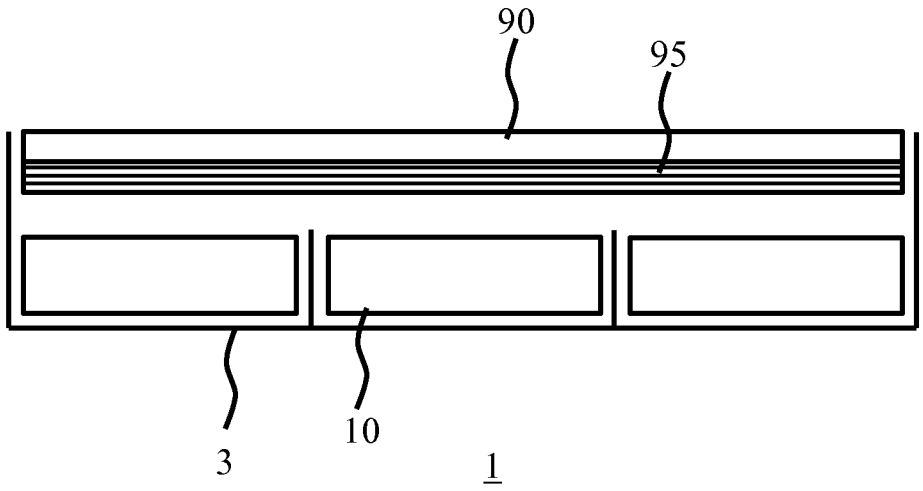
FIG. 10 schematically depicts a cross-sectional view of an assembled lighting kit according to an example embodiment.

A plurality of lighting units 10 according to embodiments of the present invention may be provided as a lighting kit, in which the lighting units 10 are designed to be coupled to each other, either by fixings and/or by a common mounting frame as previously explained. In such a lighting kit, each lighting unit 10 may have its own fabric or cloth 90 and optionally its own felt-based volumetric diffuser 95. Alternatively, the lighting kit comprises a single fabric or cloth 90 and optionally a single felt-based volumetric diffuser 95 to be deployed across all the lighting units 10 thereof. Such a lighting kit may be used to form a luminaire 1, an example embodiment of which is schematically depicted in FIG. 10, in which multiple lighting units 10 are combined in a common housing 3, e.g. a mounting frame or the like, to form the luminaire 1. In FIG. 9, the fabric or cloth 90 and the felt-based volumetric diffuser 95 are common to (i.e. shared by) the lighting units 10 by way of non-limiting example as it will be understood from the foregoing that each lighting unit 10 in such a luminaire may comprise its own fabric or cloth 90 and optional felt-based volumetric diffuser 95. Moreover, it is noted for the avoidance of doubt that the luminaire 1 may be formed by a single lighting unit 10 in an alternative embodiment.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting unit comprising:

a torsion box having a plurality of sidewalls and a grid of internal walls, each of said internal walls extending between a pair of said sidewalls, said internal walls defining a plurality of compartments within the lighting unit;

at least one solid state lighting element within at least some of said compartments; and a back panel arranged at a first opening of the torsion box delimited by the sidewalls such that the back panel covers said compartments, wherein a second opening of the torsion box delimited by said sidewalls opposing the first opening defines a light exit window of the lighting unit, and wherein at least some internal walls have a recessed central portion having a height of at most half the height of said sidewalls.

2. The lighting unit of claim 1, wherein each internal wall having said recessed central portion further comprises at least one end portion adjacent to said recessed central portion that is shaped to act as an abutment between said central portion and the sidewall contacting the end portion.

3. The lighting unit of claim 1, wherein each internal wall having said recessed central portion further comprises a pair of opposing end portions adjacent to said recessed central portion that are shaped to act as abutments between said central portion and the pair of sidewalls in between which the internal wall is arranged.

4. The lighting unit of claim 2, wherein each of said abutments has a slanted surface contacting the sidewall such that the torsion box increases in width towards the light exit window.

5. The lighting unit of claim 1, wherein the back panel is an acoustically absorbent panel.

6. The lighting unit of claim 1, further comprising a fabric spanning said second opening and defining the light exit window.

7. The lighting unit of claim 1, further comprising a felt-based volumetric diffuser in between a fabric and the internal walls of the torsion box.

8. The lighting unit of claim 1, wherein each compartment comprises a solid state lighting element centered in said compartment.

9. The lighting unit of claim 1, wherein the internal walls of the torsion box are made of metal or a polymer material.

10. The lighting unit of claim 1, wherein at least a section of each sidewall proximal to the light exit window is optically transparent.

11. The lighting unit of claim 1, wherein each internal wall is at least partially optically transparent.

12. The lighting unit of claim 11, wherein each internal wall comprises one of a perforated plate and a lattice structure.

13. A lighting kit comprising a plurality of lighting units of claim 1, wherein the lighting units are configured to be coupled to each other.

14. The lighting kit of claim 13, further comprising a fabric for spanning the plurality of lighting units when coupled together.

* * * * *